United States Patent [19]

Krüger et al.

[11] 4,449,487

[45] May 22, 1984

[54] INTERNAL-COMBUSTION ENGINE HAVING LUBRICATING AND COOLING OIL CIRCUITS

[75] Inventors: Hermann Krüger; Hermann Deutsch, both of Wolfsburg, Fed. Rep. of Germany

[73] Assignee: Volkswagenwerk AG, Wolfsburg, Fed. Rep. of Germany

[21] Appl. No.: 322,723

[22] Filed: Nov. 18, 1981

[30] Foreign Application Priority Data

Nov. 27, 1980 [DE] Fed. Rep. of Germany ..... 3044603

[51] Int. Cl.[3] ..... F01P 1/06; F01P 3/12

[52] U.S. Cl. ..... 123/41.34; 123/196 AB; 123/196 R; 123/41.42; 123/41.33

[58] Field of Search ..... 123/196 R, 196 AB, 41.42, 123/41.34, 41.33; 415/143

[56] References Cited

U.S. PATENT DOCUMENTS

| | | | |
|---|---|---|---|
| 2,078,499 | 4/1937 | Ljungström | 123/41.42 |
| 2,244,641 | 6/1941 | Fedders | 123/196 AB |
| 2,275,576 | 3/1942 | Ware | 123/196 AB |
| 3,116,908 | 1/1964 | Wosika | 415/143 |
| 4,352,455 | 10/1982 | Moser et al. | 123/196 AB |

*Primary Examiner*—Charles J. Myhre
*Assistant Examiner*—E. Rollins Cross
*Attorney, Agent, or Firm*—Spencer & Frank

[57] ABSTRACT

An internal-combustion engine includes an oil reservoir, a lubricating oil circuit, a lubricating oil pump drawing oil from the oil reservoir and driving the oil in the lubricating oil circuit and a cooling oil circuit coupled to the lubricating oil circuit. There is further provided a cooling oil pump drawing oil from the oil reservoir and driving the oil in the cooling oil circuit. The cooling oil pump has a lower output pressure than the lubricating oil pump.

13 Claims, 5 Drawing Figures

INTERNAL-COMBUSTION ENGINE HAVING LUBRICATING AND COOLING OIL CIRCUITS

BACKGROUND OF THE INVENTION

The present invention relates to an internal-combustion engine including a lubricating oil circuit having a lubricating oil pump and an oil reservoir and further including a cooling oil circuit which is coupled to the lubricating oil circuit and which is supplied from the oil reservoir.

An internal-combustion engine of the above type is disclosed in German Offenlegungsschrift (Laid-Open Application) No. 2,609,844 wherein in an air-cooled internal-combustion engine in the hot regions of the cylinder heads at least one channel is provided in which the lubricating oil, functioning there as cooling oil, is driven by the oil pump. This measure takes into consideration the fact that in air-cooled internal-combustion engines, which in principle offer the advantage of a simple construction, there may occur high temperatures at least at certain locations. Such high temperatures are to be reduced by the additional oil cooling.

A significant feature of the prior art construction is the use of a single oil pump generating the flow of both the lubricating oil and the cooling oil. In view of the amount of energy required to drive the oil pump, this measure is justified if only individual regions of the engine are to be cooled by the oil.

SUMMARY OF THE INVENTION

It is an object of the invention to provide an improved internal-combustion engine of the above-described type in which the oil assumes at least the predominant portion of the heat removal from the internal-combustion engine and the amount of energy required to generate the cooling oil flow is limited.

This object and others to become apparent as the specification progresses, are accomplished by the invention, according to which, briefly stated, the cooling oil circuit includes a cooling oil pump which operates at a lower pressure level than the lubricating oil pump.

The use of two oil pumps is of advantage, compared to a single, correspondingly larger oil pump, because a higher pressure must be generated in the lubricant circuit than in the cooling oil circuit so that the cooling oil pump can operate at a lower pressure level than the lubricant pump. According to a further feature of the invention, the cooling oil pump is therefore provided with conduits through which it can provide low pressure, spray or immersion lubrication for parts of the internal-combustion engine, such as, for example, valve driving members.

According to another feature of the invention, in internal-combustion engines having a crankshaft, the cooling oil pump is driven directly by the crankshaft as it is customary for the lubricant pump.

It is feasible to combine the two oil pumps into a pump unit. For water-cooled internal-combustion engines with two coolant circuits in which there exist different temperature and pressure conditions, an appropriate construction is disclosed, for example, in German Auslegeschrift (Accepted Published Application) No. 2,000,003. A dual-flow lubricant pump which may find use within the scope of the present invention is also disclosed in United States Patent Application by Krü ger, Ser. No. 247,762, filed Mar. 26th, 1981. The pump described therein assures the required supply of lubricating oil quantities with the smallest possible energy consumption.

According to a further feature of the invention, heat exchangers may be provided in the cooling oil circuit for removing and utilizing the heat absorbed by the cooling oil, as generally known for water cooling systems. Expediently, the heat exchanger is arranged in an exhaust conduit of the engine whereby, as known from water cooling systems, the cooling oil circuit is utilized to warm up as rapidly as possible certain parts of the internal-combustion engine after a cold start.

DESCRIPTION OF THE PREFERRED EMBODIMENTS

Figure 1:
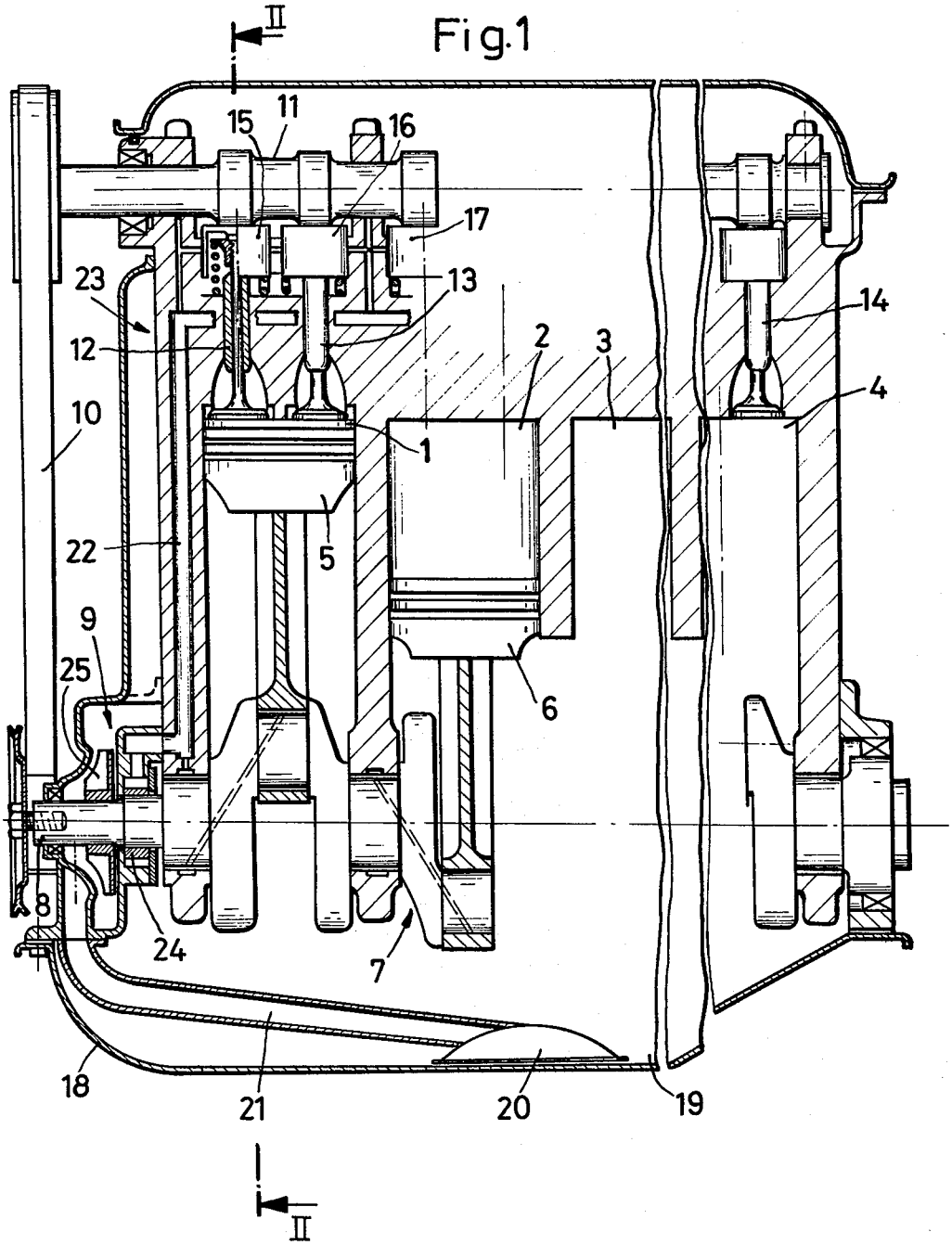
FIG. 1 is a side elevational sectional view of parts of an internal-combustion engine incorporating a preferred embodiment of the invention.
Figure 2:
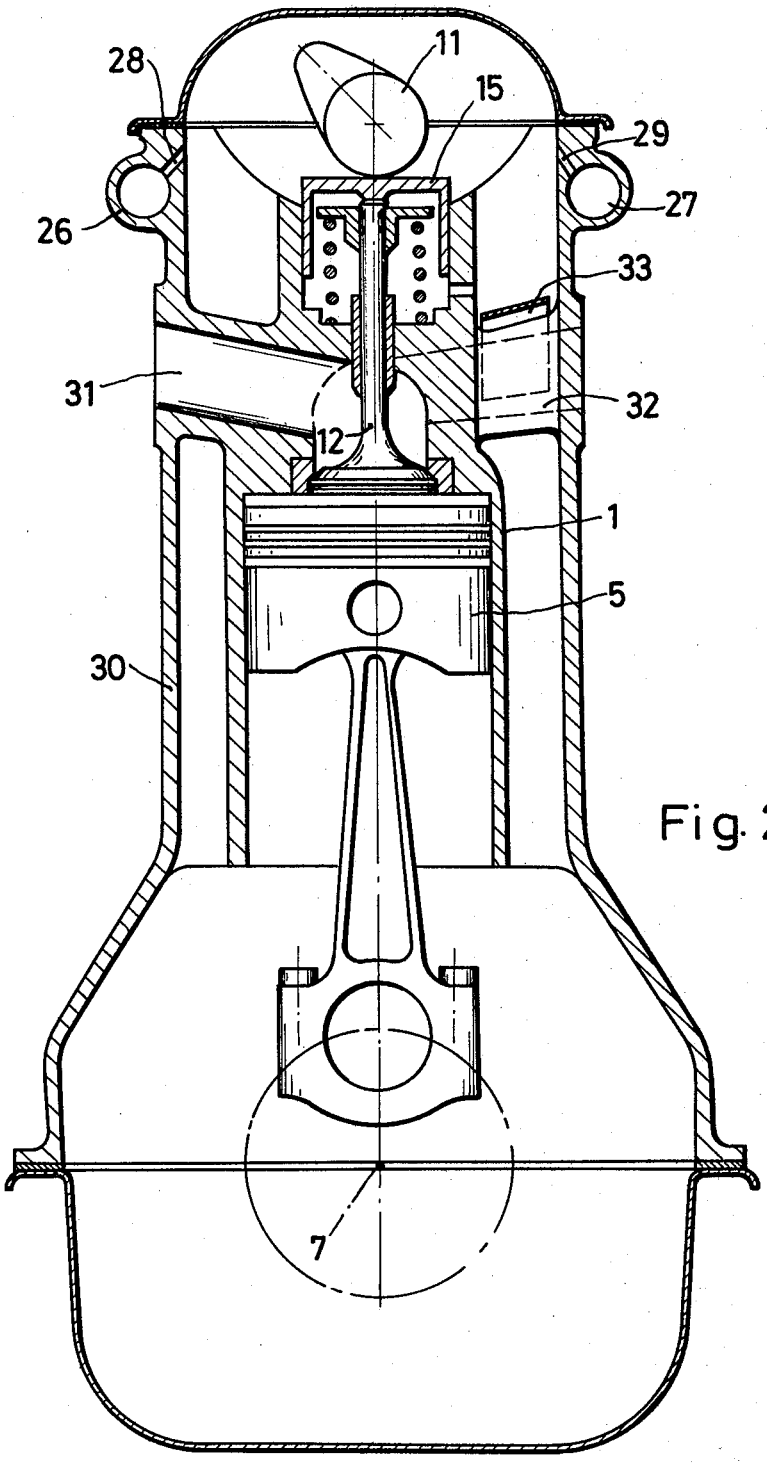
FIG. 2 is a front elevational sectional view of the engine taken along line II—II of FIG. 1.

Referring first to FIGS. 1 and 2, there is shown a reciprocating piston-type internal-combustion engine having four cylinders 1, 2, 3 and 4 in an in-line arrangement. The pistons which reciprocate in the cylinders and of which only pistons 5 and 6 associated with cylinders 1 and 2 are shown, operate in the usual manner through connecting rods acting on the crankshaft 7, whose end stub 8 drives an oil pump unit 9 to be described later and, by means of a V-belt 10, a camshaft 11 which actuates the valves of all cylinders 1 through 4 (only valves 12, 13 and 14 are shown; they are equipped with bucket tappets 15, 16 and 17).

The oil pump unit 9 conveys the lubricating and cooling oil from the oil reservoir 19 formed by the oil pan 18 through the filter 20 and the suction line 21 into the lubricant circuit 22 at a relatively high pressure and into the cooling oil circuit 23 at a relatively low pressure. For this purpose, the oil pump unit 9 includes a lubricating oil pump 24 designed as a gear pump and a cooling oil pump 25 designed as a centrifugal pump. The lubricating pump 24 generates a higher pressure level than the cooling oil pump 25 which drives a larger quantity of oil so that the energy consumed for driving the two pumps is limited to the requirements.

The cooling oil circuit 23 includes conduits 26 and 27 which spray, by means of nozzle-like outlet openings 28 and 29, cooling oil into the region of the camshaft 11 and the valve driving members cooperating wih the camshaft both for cooling and lubricating. The cooling oil then flows down the cylinder walls along cooling channels which are formed by the space between the cylinder walls 1 through 4 on the one hand and the engine housing 30 on the other hand. This space is interrupted only by vertical ribs, the intake lines 31 and the exhaust gas conduits 32. Impact shields 33 for the cooling oil are provided on the exhaust gas conduits 32 to prevent coking of the cooling oil at the very hot walls of the exhaust gas conduits.

Heat exchangers conventionally used in water cooling systems may be provided in the cooling oil circuit 23 so as to assure that the necessary amount of heat is discharged to the ambient air or to media to be heated, so as to provide for renewed cooling of the cooling oil.

Figure 3:
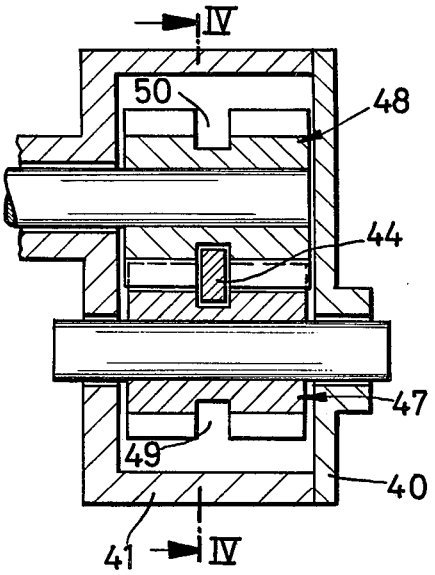
FIG. 3 is an axial sectional view of an oil pump unit forming another preferred embodiment of the invention.
Figure 4:
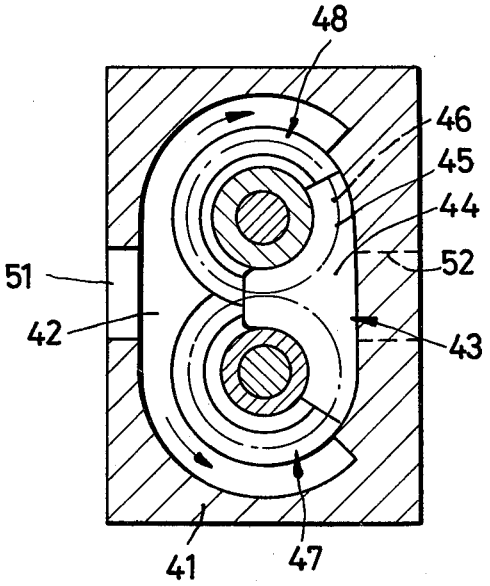
FIG. 4 is a sectional view taken along line IV—IV of FIG. 3.

FIGS. 3 and 4 show another embodiment of an oil pump unit for use according to the invention. As regards its pressure chamber, this pump unit is a dual-flow external gear pump. Such a pump unit is described, as noted before, in U.S. Application by Krüger, Ser. No. 247,762 which is hereby incorporated by reference. The pump unit has a housing 41 which is provided with a cover 40 and which forms a suction chamber 42 and a pressure chamber 43 which are divided by the partition plate (septum) 44 into the two pressure chambers 45 (in FIG. 4 in front of the septum 44) and 46 (in FIG. 4 behind the septum 44). The septum 44 which may be a separate component or part of the housing 41, projects into the region of the external gears 47 and 48 forming the displacement bodies. The two external gears 47 and 48 are each provided in their center with a recess 49 and 50, respectively, to accommodate the free edge of the septum 44. As a result of this construction, the pump unit has one suction inlet 51 but two pressure outlets. The pressure outlet 52 which is disposed behind the plane of FIG. 4, is connected with the lubricant circuit 22 of FIG. 1, while the other outlet (not shown), which is disposed in front of the plane of FIG. 4, is connected with the cooling oil circuit 23 of FIG. 1. By appropriately designing the active members of the pump with respect to the flow conditions in the two oil circuits 22 and 23, there is assured the required relatively high oil pressure in the lubricant circuit 22 and the necessary, relatively large throughput at low oil pressure in the cooling oil circuit 23.

Figure 5:
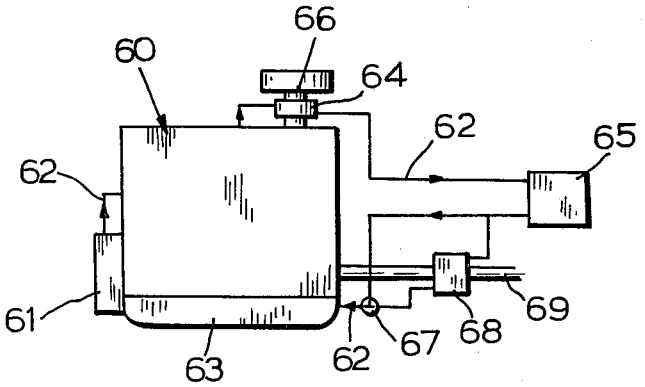
FIG. 5 shows another embodiment of the invention.

In the embodiment of FIG. 5, engine 60 again is fed with cooling oil by cooling oil pump 61 via cooling oil circuit 62 which delivers cooling oil back into oil reservoir 63 from which it is drawn by cooling oil pump 61. Cooling oil circuit 62 contains heat exchanger 64 surrounding air intake pipe 66 of the engine 60 in order to preheat the air sucked into the cylinders of the engine and heat exchanger 65 lying in the path of air to be fed into the compartment of the car equipped with the engine for heating purposes. By valve 67 the cooling oil can be forced to flow through heat exchanger 68 surrounding exhaust pipe 69 of the engine during warm-up period of the engine so that the engine will be heated by the heat of the exhaust gas as long as the engine is cold.

It will be understood that the above description of the present invention is susceptible to various modifications, changes and adaptations, and the same are intended to be comprehended within the meaning and range of equivalents of the appended claims.

What is claimed is:

1. An internal combustion engine comprising in combination:

(a) an oil reservoir;

(b) a lubricating oil circuit being in communication with and including said oil reservoir;

(c) a lubricating oil pump in said lubricating oil circuit for drawing oil from said oil reservoir and driving the oil in said lubricating oil circuit;

(d) a cooling oil circuit being in communication with and including said oil reservoir;

(e) a cooling oil pump in said cooling oil circuit for drawing oil from said oil reservoir with the circumvention of said lubricating oil pump and driving the oil in said cooling oil circuit; said cooling oil pump having a lower output pressure than said lubricating oil pump; and (f) engine components being in communication with said cooling oil circuit for exposure to oil driven by said cooling oil pump in said cooling oil circuit.

2. An internal-combustion engine as defined in claim 1, further comprising an engine crankshaft; said cooling oil pump being directly driven by said engine crankshaft.

3. An internal-combustion engine as defined in claim 1, further comprising conduit means for a low-pressure lubrication of engine components, said cooling oil pump being connected to said conduit means for supplying oil thereto.

4. An internal-combustion engine as defined in claim 3, said conduit means comprising a conduit for a spray lubrication of engine components; said cooling oil pump being connected to said conduit for supplying oil thereto.

5. An internal-combustion engine as defined in claim 1, wherein said lubricating oil pump and said cooling oil pump form a unitary pump structure comprising separate pressure chambers communicating, respectively, with said lubricating oil circuit and said cooling oil circuit.

6. An internal-combustion engine as defined in claim 5, wherein said unitary pump structure further comprises a pump drive shaft, an impeller mounted on said pump drive shaft and a septum separating said pressure chambers from one another.

7. An internal-combustion engine as defined in claim 5, wherein said unitary pump structure comprises a gear-type impeller driving oil in the pressure chamber communicating with said lubricating oil circuit and a centrifugal impeller driving oil in the pressure chamber communicating with said cooling oil circuit.

8. An internal-combustion engine as defined in claim 7, wherein said unitary pump structure further comprises a single pump drive shaft carrying said impellers.

9. An internal-combustion engine as defined in claim 1, further comprising at least one heat exchanger contained in said cooling oil circuit.

10. An internal-combustion engine as defined in claim 9, wherein said internal-combustion engine constitutes the power plant of an automotive vehicle having a compartment for occupants; a heater for supplying heat to said compartment; said heater comprising said heat exchanger.

11. An internal-combustion engine as defined in claim 9, wherein said heat exchanger is situated on an exhaust pipe of said engine.

12. An internal-combustion engine as defined in claim 9, wherein said heat exchanger is arranged for transferring heat to engine components to be preheated.

13. An internal-combustion engine as defined in claim 12, wherein said engine component is an intake pipe.

* * * * *